United States Patent [19]

Marbourg, Jr.

[11] Patent Number: 4,611,515

[45] Date of Patent: Sep. 16, 1986

[54] TOOL FOR CONTROL AND USE OF MINIATURE SCREWS AND THREADED FASTENERS

[76] Inventor: Edgar F. Marbourg, Jr., 437 Hillcrest Rd., San Carlos, Calif. 94070

[21] Appl. No.: 790,120

[22] Filed: Oct. 22, 1985

Related U.S. Application Data

[60] Division of Ser. No. 577,071, Jan. 26, 1984, Pat. No. 4,581,962, which is a continuation-in-part of Ser. No. 385,540, Jun. 7, 1982, Pat. No. 4,455,898.

[51] Int. Cl.[4] ..... B25B 23/08

[52] U.S. Cl. ..... 81/454

[58] Field of Search ..... 81/451, 452, 454, 453, 81/455, 456, 457, 458, 125

[56] References Cited

U.S. PATENT DOCUMENTS

| | | | |
|---|---|---|---|
| 796,154 | 8/1905 | Schulze | 81/453 |
| 1,300,275 | 4/1919 | Johnson | 81/436 |
| 2,796,100 | 6/1957 | Dierker | 81/457 |
| 3,707,894 | 1/1973 | Stillwagon | 81/451 |
| 4,190,091 | 2/1980 | Colognori | 81/453 |

*Primary Examiner*—James L. Jones, Jr.

*Attorney, Agent, or Firm*—Marshall C. Gregory

[57] ABSTRACT

In combination with a miniature jewelers' screwdriver, or similar tool, a barrel made of a stiffly flexible material (preferably a specified plastic) incloses the shaft of the screwdriver. The barrel provides at its working or tip end a set of flexible elements combined with a head holding groove to provide a gripping head which securely holds miniature screws or similar fasteners registered with the screwdriver tip. At the barrel's other end a coil spring around the shaft of the screwdriver exerts pressure to extend the barrel's tip beyond the bit of the screwdriver so that it will act to engage and hold screw heads.

2 Claims, 5 Drawing Figures

TOOL FOR CONTROL AND USE OF MINIATURE SCREWS AND THREADED FASTENERS

NATURE OF APPLICATION

This is a divisional application based on application Ser. No. 577,071, filed 1-26-84 issued as U.S. Pat. No. 4,581,962, which application in turn was a continuation-in-part of earlier application Ser. No. 385,540, filed June 7, 1982 and issued June 26, 1984 as U.S. Pat. No. 4,455,898. Number 577,071 was also identical in text and figure content with PCT application No. PCT/US83/00855, filed June 3, 1983, based on the earlier priority application Ser. No. 385,540.

This application is being filed to be co-pending with application Ser. No. 577,071 as to the matter disclosed herein, Ser. No. 577,071 having been found allowable as to other parts. After filing of this application, deletion of the duplicated material from Ser. No. 577,071 will be requested.

No new matter is contained in this application, although the discussion and introductory material, extracted from one or the other of the previous applications, may be rephrased or edited for specific reference to the restricted scope of this application. The drawings submitted herewith have been transferred (with new numbers), from those submitted with Ser. No. 577,071. One minor change has been made in the drawings in that the detail of the screw-gripping mechanism shown in FIG. 2 has been simplified as compared with the corresponding figure of the parent application. This is in conformance with the disclosure in the specification of the parent application that the miniaturized screwdriver form was provided with a simplified screw-gripping means. The simplification consists in the provision of only one annular groove and land, as compared to the two shown in the figure for the parent application. In other respects the design is the same.

FIELD OF THE INVENTION

This invention is an improvement applicable to a common group of tools, namely screwdrivers and similar tools for starting and driving, or in a converse sense finding and removing screws or other threaded fasteners. The specific application herein is to that class of tools which might be called jewelers' screwdrivers, for use with small screws or machine screws, such as those commonly found in eyeglasses or similar applications. While the parent application addressed itself primarily to the problems found in handling threaded fasteners of larger size in connection with structural and assembly applications, the particular focus of the current device is the special difficulty of handling and employing the very small screws (more usually machine screws, but the word screws will be used herein as generally applicable) employed in the applications referred to above.

The proposed invention disposes an assembly or device, attached or affixed to a small screwdriver (or more properly a set of these combinations covering the desired range of miniature screw sizes) which provides a means to hold these small screws engaged to the tip of the screwdriver for starting and driving, or in the converse application to provide for guiding the tip when engaging a screw for withdrawal and for gripping and holding it as it is withdrawn.

PRIOR ART

Applicant's prior applications contained a summary of previous disclosures and descriptions in the general field of screwdrivers and allied tools with various adaptations or attachments intended to provide for holding screws and fasteners to the tool to allow one-handed operation or operation in recesses difficult of access or vision. Reference was made to a summary article on the field of such tools in the May 1982 issue of Popular Science magazine, beginning on page 132, with particular citation of the discussion of screw starters or holding devices on page 134 thereof. That discussion included forms of these devices with spring fingers or leaves which must be engaged with the head, or those with a wedge or center leaf which turns and jams in a screw slot to hold a screw on the tool bit.

Several patents have issued on various devices intended to address the problems of controlling threaded fasteners, and reference has been made in previous applications to the following U.S. Patents known to applicant to have issued listed with names of patentees, and assigned letters for ease of reference:

A number of patents have issued on various devices intended to address these associated problems, and reference will be made to the following U.S. Pat. Nos. known to applicant herein to have issued. They are listed with names of patentees, and with assigned letters for ease of reference.

| Ref. | Number | Patentee | Date |
|---|---|---|---|
| A | 355,392 | Fellers | 1887 |
| B | 601,188 | Webster | 1898 |
| C | 881,296 | Chappel | 1908 |
| D | 1,229,793 | Ryan | 1917 |
| E | 1,889,330 | Humes, et al (1) | 1932 |
| F | 1,925,385 | Humes, et al (2) | 1933 |
| G | 2,028,546 | John | 1936 |
| H | 2,566,673 | Nygaard | 1951 |
| I | 2,633,168 | Mahaffey | 1953 |
| J | 2,762,408 | Baldwin | 1956 |
| K | 2,952,285 | Roosli | 1960 |
| L | 2,954,809 | Loewy | 1960 |

These patents teach a variety of methods for gripping or holding screws and fasteners, and at least one (H,) provides for a set of removable bits or heads to convert it to a variable size wrench also. Reference D, to Ryan, involves a bulky box-shaped holding structure with a thumb lever for engagement which could not be used in a confined space or recess. Some of the features disclosed are the relatively common leaf-spring fingers (described in the Popular Science article) which must be positioned with care to hold a screw head (References A, B, I, J and K); a split tube type gripping device (References C, E, F, G, and L); and various methods of activating the holding means, such as cams (References G and L) and double or triple sleeves or barrels which act upon each other (References E, F, H, J and K). Some aver that the device automatically releases its grip (References E, F and I), while others require two-handed or two-step operation to lock and/or unlock (References A, B, D, J and L).

These previously issued patents do not directly address the particular problem which is answered by the current invention, that of the control and use of very small screws, as described previously.

SUMMARY OF THE INVENTION

The invention herein offers several advantages over earlier devices, whether or not they were applicable to miniaturized screws or assemblies. It provides simple operation in confined spaces, not requiring two hands or a separate tool to engage it to or release it from a screw head. It accurately locates a screw which is to be removed, aligning the bit or blade with the head, captures the screw head easily, and maintains the tool bit in register with the screw head whether removing it or driving it home. It also is easy to disengage from the head of a screw which has been seated—the holding leaves of the spring leaf types in particular may be captured under the screw head and jammed if not earlier disengaged, an operation which may be difficult in a confined space. An auxiliary holding device is provided as a convenience to facilitate inserting the small screws in the tool gripping means, as well as helping to align sockets or hinges for assembly, such as for example replacing a screw holding an eyeglass frame hinge assembled, making the operation of the tool even simpler.

The invention comprises a barrel or sleeve-type mechanism, made of a tough, resilient type material, configured to slide over an associated miniature screwdriver with which it cooperates in a manner to be described herein. At one end (that cooperating with the tip of the associated screwdriver) the barrel provides a screw head gripping and holding means to be described; at the other it disposes an annular recess to accept a spring installed around the shaft of the associated screwdriver, which acts to extend the barrel for use. Slots in the barrel cooperate with a guide pin affixed to the screwdriver shaft to limit and control the movement of the barrel on the shaft of the associated tool.

Fundamental to the design and improvement offered by the invention is the use of a material of proper characteristics combining not only the toughness to withstand the use intended, but also the resiliency to repetitively produce the spring action necessary to acccpt and grip the screw heads. While the device would work well if fabricated from certain metals, such as brass, the production costs would be extremely high, and the concept of the invention is to produce inexpensive sets of cooperating tools. It is therefor preferred to make it from a plastic of the requisite toughness, flexibility and elasticity, which is capable of being injection-molded and finish-machined (if required) inexpensively and by automated processes. A material meeting these requirements is marketed by the DuPont Company under the name Delrin. It is a poloxymethylene, and may be considered in the classes of a polyacetal or polyformaldehyde. The basic Delrin might well be satisfactory, but it is preferred to use a variety which has been "rubber-toughened" by a proprietary process, and is designated Delrin 500T (for "tough"). There is also a Delrin 100ST ("super tough") which could be used. Characteristic of the toughened types of Delrin is that the failure mode is changed from a brittle fracture mode in the basic Delrin to a ductile failure mode (rough tearing) in the 100ST and 500T varieties. There are other materials which could be used and the invention is of course not limited solely to the use of the preferred material. An advantage of the preferred material designated is that the barrel may be cast by injection molding.

DESCRIPTION OF THE PREFERRED EMBODIMENT AND BEST MODE

Referring first to FIG. 1, the parts of the invention are shown separated. In FIG. 1*a*, there is depicted a small screwdriver 10, with the shaft and bit together denoted by 11. Depicted thereon are a delrin tube 12 and barrel control pin 13 which are molded as an integral piece and then cemented to the shaft of the screwdriver as shown, with one of several available "super glues". The spring 14 shown around the shaft is preferably assembled on the shaft prior to the cementing thereon of tube 12 and pin 13.

Figure 1A:
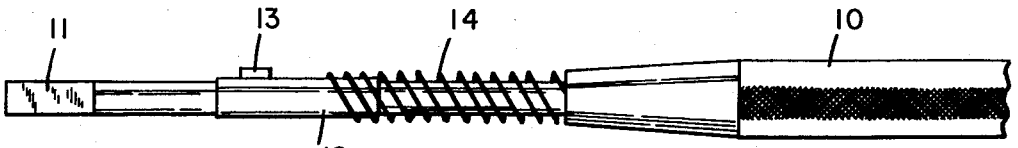
FIG. 1*a* shows a jewelers' or miniature screwdriver modified with a spring and guide pin to cooperate with the barrel of the invention.
Figure 1B:
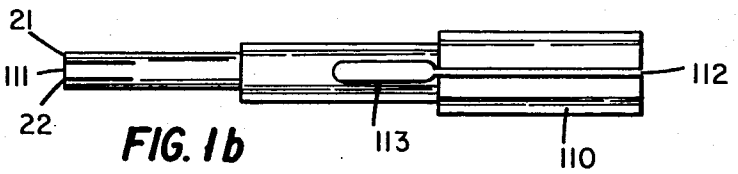
FIG. 1*b* shows the barrel of the invention.

FIG. 1*b* shows the barrel 110 for use in cooperation with the small screwdriver of FIG. 1*a*. Shown in the barrel is a slot divided into two sections, denoted as 112 and 113. The width of slot 112 is slightly less than the diameter of breadth of pin 13, while slot 113 is slightly wider than pin 13. Barrel 110 is assembled onto the shaft of screwdriver 10 by forcing slot 112 past pin 13, as slot 112 will expand far enough, slightly deforming barrel 110 temporarily, to allow passage of pin 13. After assembly, pin 13 acts within wider slot 113 to control the movement of barrel 110 along the shaft of screwdriver 10. In the larger (right) end of barrel 110 is an annular recess into which spring 14 enters (not detailed in the figure). Spring 14 exerts pressure upon barrel 110 to keep it extended beyond the working tip of screwdriver 10, so that the very small machine screws may be engaged with a minimum of effort and firmly retained in the grip means 111 at the end of barrrel 110. Keeping the barrel extended by spring pressure is preferable to attempting to manually slide it back and forth, in view of the small size of the tool.

Figure 2:
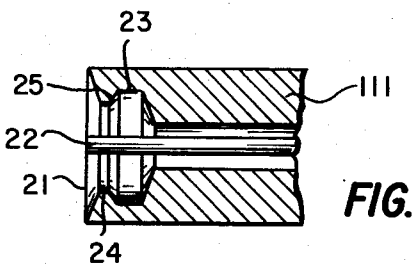
FIG. 2 is a detail of the grip means construction in the barrel of the invention.

At the tip end of barrel 110, associated with the tip of the cooperating tool 10 (at the left in the drawing) there is disposed screw-gripping means 111, details of which are shown in FIG. 2. The tube of barrel 110 is slit longitudinally into a plurality of segments 21 by slots 22, which extend far enough into barrel 110 so that segments 21 act as flexible members which will open to accept a screw head, then elastically return to grip and hold it. The preferred number of segments 21 for the small size screws is 3 or 4, although depending on the mode of manufacture, from 2 to 6 would be satisfactory. Grip means 111 holds screw heads by a combination of the spring action of segments 21 with annular groove 23 formed interiorly in the end of grip means 111. Annular groove 23, separated from the end of barrel 110 by shoulder 24, is especially adapted to hold the head of a screw. The angle of face 25 (as well as the face opposing it on the other side of groove 23) to the longitudinal axis of barrel 110 is approximately 75 degrees, although a range of angles about this number would function satisfactorily. This angle not only provides for a cam action to flex the segments or fingers 21 and allow entry of a screw head, and then facilitate its holding, but also acts to allow release of a screw head, as in the case where it has been driven home.

Figure 1C:
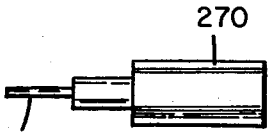
FIG. 1*c* is a side view of the auxiliary holding and aligning tool.
Figure 1D:
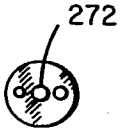
FIG. 1*d* shows screw holding holes in the auxiliary tool.

An auxiliary tool designed to make use of this miniature screwdriver more convenient is shown in a side view in FIG. 1*c* and an end view in FIG. 1*d*. The tool 270 can be made of brass or other suitable material and is particularly adapted to facilitate the replacement of hinge screws in eyeglass frames. Holes 272 (FIG. 1*d*) provide for placing the screws therein for holding; then aligning pin 271 is used to align the hinges on the frame of the glasses, after which the miniature screwdriver 10 can be used. Forcing grip-means 111 of barrel 110 against a screw held in auxiliary tool 270 (in a hole 272) will cause the screw head to be firmly gripped in grip means 111, then it can be inserted in the frame hinge and screwed down, whereupon it will be released. This can be done by touch alone, without requiring the use of a second pair of glasses or other visual aid.

It should be clear that minor variations of the disclosed invention are possible, or other apparent modes of use, and these variations are considered to be within the scope of the disclosed invention.

I claim as my invention:

1. A miniature screwdriver or tool for very small threaded fasteners, around the shaft of which has been installed a coil spring one end of which bears upon the handle of said tool, said spring extending substantially down said shaft of said tool, further providing that fixedly attached to the shaft of said tool, between said coil spring and the tip of said tool is a tube of stiff, tough but resilient material disposing outwardly a small projecting pin to act as a guide pin;

that associated with said tool, a barrel of stiff but resiliently deformable plastic encompasses said tool shaft so that the tip of said tool is in a closely cooperative relationship with one end of said barrel, said end of said barrel being of the minimum practicable diameter;

that at said end of said barrel which is associated with said tip of said tool, said barrel is slit longitudinally into a plurality of relatively thin, flexible segments which act as resilient gripping members for gripping heads of small threaded fastners, in association with an annular groove and shoulder in the interior surfaces of said resilient members which positively grip said head of a fastener accepted by said flexible members which expand outward to accept said fastener head, then contract upon it;

that the other end of said barrel be formed into a head section of greater diameter, disposing at the end of said head section nearest the handle of said cooperating tool an annular recess which accepts the end of said coil spring assembled upon said shaft of said tool, which said spring bears upon said handle of said tool and upon said barrel to extend said barrel towards the said tip end of said tool;

that one longitudinal slot, of width slightly less than the diameter of said guide pin on said tool shaft, extend from the end of said head section of said barrel nearest the handle of said associated tool a substantial distance into the part of said barrel which is of reduced diameter, terminating in a broadened portion of said slot, of width slightly greater than the diameter of said guide pin;

so that the said barrel may be emplaced over the shaft of said cooperating tool by forcing said slot in said barrel over said guide pin, said barrel deforming sufficiently to pass said guide pin, so that said guide pin is then contained within said broadened portion of said slot to limit and guide movement of said barrel relative to said tool shaft.

2. Associated with a miniature tool with barrel as described in claim 1 an auxiliary tool provided at its base with holes which will hold small threaded fasteners ready for use, and at its other end a tip for aligning small holes in work pieces, such as frames for eyeglasses.

* * * * *